United States Patent [19]

Cosaert

[11] Patent Number: 4,863,028

[45] Date of Patent: Sep. 5, 1989

[54] REEL LAND CRATE CONTAINING ONE OR MORE REELS ACCORDING TO THE INVENTION

[75] Inventor: Pierre Cosaert, Kortrijk, Belgium

[73] Assignee: N.V. Bekaert S.A., Zwevegem, Belgium

[21] Appl. No.: 281,340

[22] Filed: Dec. 8, 1988

[30] Foreign Application Priority Data

Jan. 11, 1988 [BE] Belgium ..... 8800028

[51] Int. Cl.[4] ..... B65H 75/14; B65D 85/04

[52] U.S. Cl. ..... 206/391; 242/118.4; 242/118.6; 206/398

[58] Field of Search ..... 242/118.4, 118.41, 118.5, 242/118.6, 118.61, 118.62, 118.7, 118.8; 206/389, 391, 397, 398

[56] References Cited

U.S. PATENT DOCUMENTS

| | | | |
|---|---|---|---|
| 1,036,644 | 8/1912 | Kilmer et al. | 242/118.6 |
| 3,480,229 | 11/1969 | D'Entremont | 242/118.4 |
| 3,485,350 | 12/1969 | Overton, III . | |
| 4,492,350 | 1/1985 | Gdetluck . | |

FOREIGN PATENT DOCUMENTS

| | | | |
|---|---|---|---|
| 2401850 | 3/1974 | France . | |
| 493412 | 8/1970 | Switzerland . | |
| 8361 | of 1889 | United Kingdom | 242/118.4 |
| 261177 | 11/1926 | United Kingdom | 242/118.7 |
| 879085 | 10/1961 | United Kingdom | 242/118.4 |

*Primary Examiner*—William Price
*Attorney, Agent, or Firm*—Shlesinger & Myers

[57] ABSTRACT

The invention relates to a reel (1) comprising a core (2) and two flanges (3) holding elongated material (4), such as wire, ribbon-like material, etc. wound on the core (2) between the flanges (3) and whereby each flange (3) of the reel (1) is a substantially rectangular panel (3) (see FIG. 1). More in particular, the invention relates to a crate (10) containing one or more reels (1) and comprising at least four vertical walls, a base and a top, whereby the base and the top of crate (10) are symmetrical and have been provided with supporting elements (11) to accommodate the ends (6) of the flanges (3) of the reels (1) held in the crate (10).

9 Claims, 2 Drawing Sheets

REEL LAND CRATE CONTAINING ONE OR MORE REELS ACCORDING TO THE INVENTION

FIELD OF THE INVENTION

The invention relates to a reel comprising a core and two flanges whereby elongated material such as wire or ribbon-like material etc. is wound on the core between the flanges.

BACKGROUND OF THE INVENTION

Most flanges made to date are circular in shape. Some disadvantages of such circular flanges include high manufacturing costs and the low stability of such reels during transport.

Support blocks must be mounted on at least one of the flanges of a reel with circular flanges holding elongated material to facilitate stacking and to enable the reel to be lifted from the ground with a lifting device. However, the presence of such support blocks also has disadvantages, such as increased volume during transport and the fact that their presence must be taken into account when winding or unwinding the reel.

OBJECTS AND SUMMARY OF THE INVENTION

It is an object of the invention to provide a novel reel as well as a crate containing one or more reels according to the invention, without the above disadvantages.

Thereto, a first embodiment of the invention entails that each flange of a reel as described above consists of a substantially rectangular panel. A substantially rectangular panel is here defined as a panel with straight short sides and preferably straight long sides. These long sides may, however, also be curved or have any other shape.

The width of each flange is preferably smaller than the outside diameter of the elongted material wound onto the core. It is even possible to use rectangular flanges having a width that is smaller than the inside core diameter.

The length of each rectangular flange is preferably larger than the outside diameter of the elongated material wound on the core, so that the ends of the rectangular flanges extend above and below the material wound on the core.

The elongated material is preferably a ribbon consisting of adjacent wires that are interconnected by for example an adhesive. The width of the ribbon of adjacent wires is substantially equal to the distance between the two flanges of the reel.

The invention also relates to a crate containing one or more reels according to the invention, whereby this crate comprises at least four vertical sides, a base and a top. According to the invention, the base and the top of the crate are symmetrical and provided with supporting elements holding the ends of the rectangular flanges of the reels placed therein.

In a preferred embodiment of the crate according to the invention containing one or more reels according to the invention, each supporting element consists of a frame made of four battens fastened substantially at right angles to each other, whereby the distance between the transverse battens is virtually the same as the width of the rectangular flanges of a reel placed in the crate and whereby the distance between the longitudinal battens of the frame virtually equals the depth or thickness of the reel.

It is an important advantage of the reels and the crate according to the invention that the reels are stacked very securely inside the crate. The ends of the rectangular flanges are firmly held in their corresponding supporting elements of the base and the top of the crate.

Another important advantage of the invention is that during transport, the reels need no longer be stacked on top of each other but are positioned besides each other inside the crate. A further advantage is that stackability is considerably improved, because the reels are now placed besides each other inside the crate and their rectangular flanges serve to support the crate stacked on top.

Because the reels are no longer stacked up on top of each other during transport, but besides each other, it is another important advantage of the invention that it is no longer necessary to provide at least one flange of the reel with support blocks. This greatly facilitates the handling of the reel.

DESCRIPTION OF THE DRAWINGS

The invention will now be further explained in the following description and the accompanying figures. These show.

DETAILED DESCRIPTION OF THE INVENTION

Figure 1:
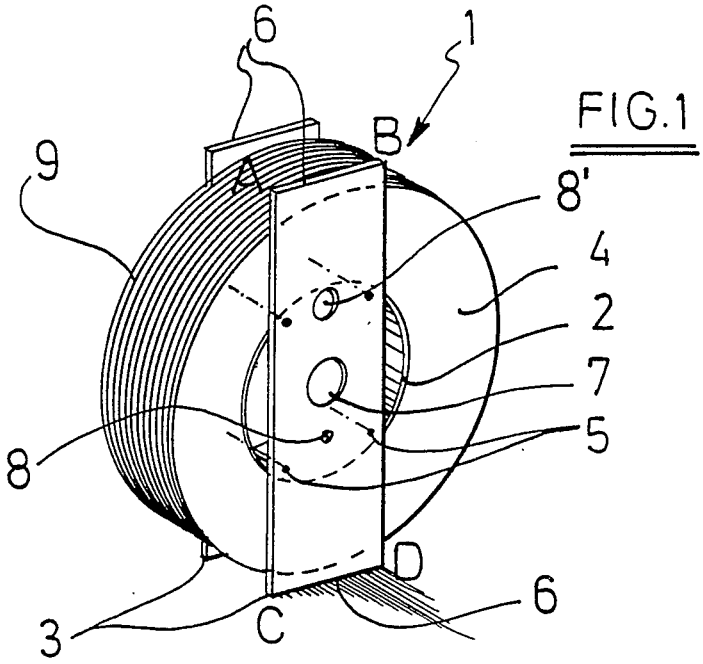
FIG. 1: A perspective view of one embodiment of a reel with rectangular flanges according to the invention.

FIG. 1 shows a perspective view of a first embodiment of a reel 1 according to the invention. The reel 1 consists of a core 2 and two flanges 3. The core 2 is preferably made from strong cardboard or another material. This core 2 is preferably cylindrical whereby its cross section is a circle. The elongated material 4, such as wire, ribbon, etc. is wound between the flanges 3 on the core 2.

An important characteristic of this novel reel 1 according to the invention is that each flange 3 is a rectangular panel. As illustrated in FIG. 1, both the short and the long sides of each flange 3 are straight. It is obvious, that manufacturing such a rectangular panel 3 is simple and cheap, entailing almost no wastage of material. These flanges 3 are preferably made from wood, chipboard, etc. The flanges 3 are connected to each other by devices 5 such as nuts and bolts. The flanges 3 are also provided with a hole 7 into which an axle can be fitted and with a catch hole 8 which can accommodate a catching pin. The flanges 3 are also provided with a hole 8' for the introduction of for example a chain or similar means for lifting or shifting reel 1 with a lifting device.

The width of each rectangular flange 3 is preferably smaller than the outside diameter of the elongated material 4 wound on core 2. As illustrated in FIG. 1, it is even possible to use rectangular flanges 3 with a width smaller than the inner diameter of core 2, so that parts of the core 2 become free, for instance for attaching a chain when shifting the reel 1 using a lifting device.

The length of each rectangular flange 3 is larger than the outside diameter of the elongated material 4 wound on core 2, so that the ends 6 of these flanges 3 extend above and below the material 4 wound on the reel 1.

The elongated material 4 is preferably made up of a ribbon of adjacent wires 9, that have been interconnected for instance with an adhesive. The width of the ribbon of adjacent wires 9 is substantially the same as the distance between the two flanges 3. In this way, 60 steel wires with a virtually rectangular cross section of $1.60 \times 1.40$ mm can for example be glued to each other to form a ribbon of about 96.5 mm wide and about 1.42 mm thick. A length of for example 350 m of this material 4 can then be wound on a reel 1.

Figure 2:
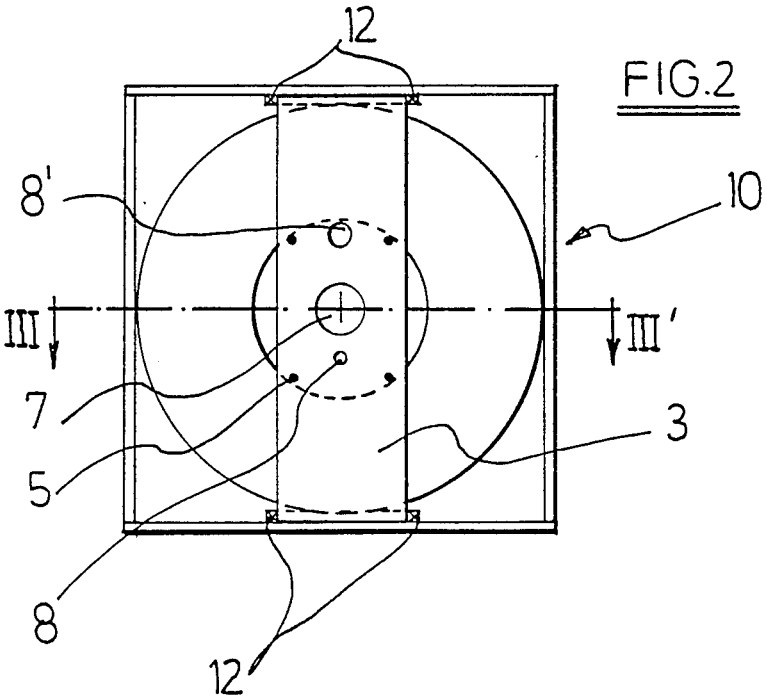
FIG. 2: A vertical cross section through a crate according to the invention containing reels, through the line II—II' in FIG. 3, FIG. 3: A horizontal cross section through a crate according to the invention containing reels through the line III—III' in FIG. 2, and FIG. 4: A second embodiment of a reel according to the invention.
Figure 3:
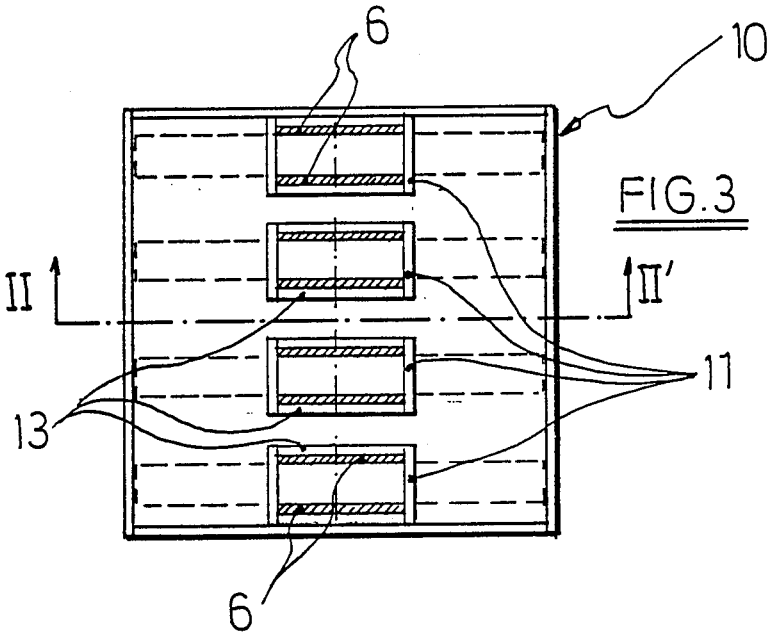

FIGS. 2 and 3 show cross sections through a crate 10 according to the invention containing four reels 1 according to the invention. The crate 10 consists of four vertical walls, a base and a top. The top and base of the crate 10 have been made symmetrical in accordance with the invention, and are provided with supporting elements 11 to accomodate the ends 6 of the flanges 3 of the reels 1 placed in the crate 10.

Each supporting element 11 consists of a frame made of four battens fastened virtually at right angles to each other in such a way that the distance between the transverse battens 12 of frame 11 almost equals the width of the flanges 3 of a reel 1 and the distance between the longitudinal battens 13 of the frame 11 almost equals the thickness or depth of this reel 1.

Several embodiments of both reel 1 and crate 10 are possible within the scope of the invention. Crate 10 can for example have more than four vertical walls, for instance eight vertical walls and a suitably adjusted top and base, provided that top and base are provided with supporting elements 11 to accommodate the ends 6 of the flanges 3 of the reels 1 placed in the crate 10.

Figure 4:
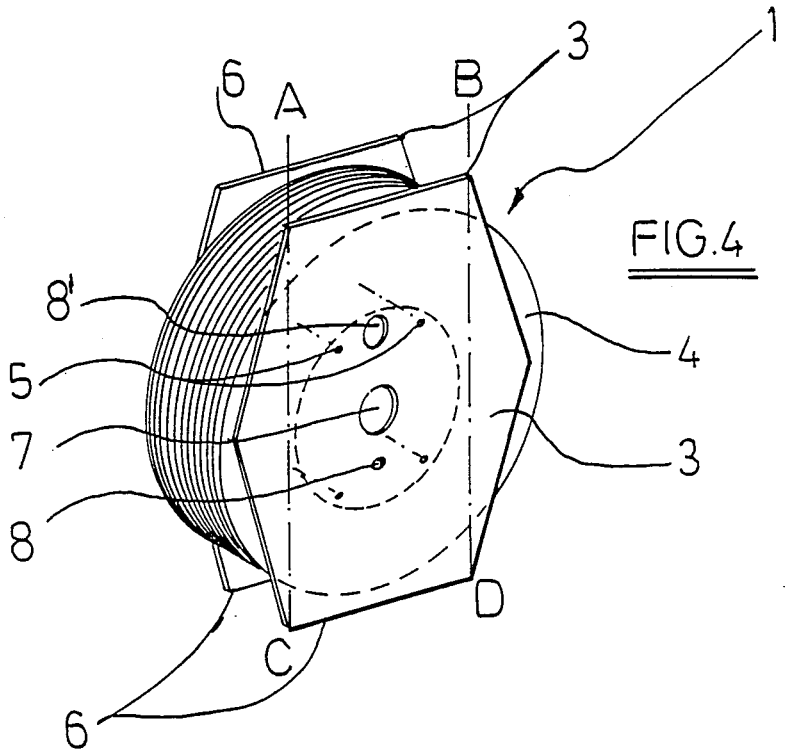

FIG. 4 illustrates another embodiment of the reel 1 according to the invention. The flanges 3 of this reel 1 are hexagonal. Again, the reel 1 is provided with flange ends 6 which can be fitted into the supporting elements 11 of the crate 10. As indicated by the dot and dash line, the hexagonal flanges 3 of this reel 1 can be converted into the preferred, viz. rectangular panel ABCD in which both the short sides 6 and the long sides are straight.

I claim:

1. A crate, comprising:

(a) a receptacle having at least four vertical walls, a top, and a base, said top and base being symmetrical to each other;

(b) at least a reel being disposed within said receptacle;

(c) said reel including a core;

(d) said core having a substantially rectangular flange on each end thereof;

(e) said reel including an elongated material wound around said core between each of said flanges, thereby permitting said elongated material to have inside and outside diameters;

(f) each of said flanges including top and bottom ends; and (g) said receptacle including means operably associated with said base and said top for supporting said top and bottom ends of each of said flanges.

2. A crate as in claim 1, wherein:

(a) the width of each of said flanges is smaller than the outside diameter of said elongated material.

3. A crate as in claim 1, wherein:

(a) the width of each of said flanges is smaller than the inside diameter of said elongated material.

4. A crate as in claim 1, wherein:

(a) the length of each of said flanges is greater than the outside diameter of said elongated material so that said top and bottom ends of each of said flanges extend beyond the outside diameter of said elongated material.

5. A crate as in claim 1, wherein:

(a) said elongated material includes a ribbon of adjacent wires interconnected to each other.

6. A crate as in claim 5, wherein:

(a) the width of said ribbon of adjacent wires is substantially the same as the distance between each of said flanges.

7. A crate as in claim 5, wherein:

(a) said ribbon of adjacent wires includes adhesive means for joining the wires together.

8. A crate as in claim 1, wherein:

(a) said support means includes a rectangular frame having the dimensions of the width of each of said flanges and the distance between each of said flanges.

9. A crate as in claim 8, wherein:

(a) said frame includes four battens secured to each other at substantially right angles.

* * * * *

UNITED STATES PATENT AND TRADEMARK OFFICE

CERTIFICATE OF CORRECTION

PATENT NO. : 4,863,028

DATED : September 5, 1989

INVENTOR(S) : Pierre Cosaert

It is certified that error appears in the above-identified patent and that said Letters Patent is hereby corrected as shown below:

In the title, on the cover sheet and in Column 1, change:
"LAND" to -- AND --

Signed and Sealed this

Sixteenth Day of October, 1990

*Attest:*

HARRY F. MANBECK, JR.

*Attesting Officer*

*Commissioner of Patents and Trademarks*